US012550940B2

(12) United States Patent
An et al.

(10) Patent No.: US 12,550,940 B2
(45) Date of Patent: Feb. 17, 2026

(54) AEROSOL GENERATING DEVICE

(71) Applicant: KT&G CORPORATION, Daejeon (KR)

(72) Inventors: Hwi Kyeong An, Seoul (KR); Sung Ho Ju, Daejeon (KR)

(73) Assignee: KT&G Corporation, Daejeon (KR)

( * ) Notice: Subject to any disclaimer, the term of this patent is extended or adjusted under 35 U.S.C. 154(b) by 397 days.

(21) Appl. No.: 17/795,136

(22) PCT Filed: Jan. 18, 2022

(86) PCT No.: PCT/KR2022/000937
§ 371 (c)(1),
(2) Date: Jul. 25, 2022

(87) PCT Pub. No.: WO2022/164110
PCT Pub. Date: Aug. 4, 2022

(65) Prior Publication Data

US 2024/0206544 A1 Jun. 27, 2024

(30) Foreign Application Priority Data

Jan. 29, 2021 (KR) ..... 10-2021-0013176

(51) Int. Cl.
*A24F 40/465* (2020.01)
*A24F 40/20* (2020.01)
*A24F 40/485* (2020.01)

(52) U.S. Cl.
CPC ..... *A24F 40/465* (2020.01); *A24F 40/20* (2020.01); *A24F 40/485* (2020.01)

(58) Field of Classification Search
CPC ..... A24F 40/46; A24F 40/40; A24F 40/20
See application file for complete search history.

(56) References Cited

U.S. PATENT DOCUMENTS 6,158,530 A 12/2000 Bowen et al.
9,693,587 B2 * 7/2017 Plojoux ..... A61M 15/06
(Continued)

FOREIGN PATENT DOCUMENTS

CN 108783605 A 11/2018
CN 109077366 A 12/2018
(Continued)

OTHER PUBLICATIONS

International Search Report for PCT/KR2022/000937 dated Apr. 28, 2022.
(Continued)

*Primary Examiner* — Alex B Efta
(74) *Attorney, Agent, or Firm* — Foley & Lardner LLP

(57) ABSTRACT

An aerosol generating device for generating an aerosol by heating an aerosol generating article includes: a case; a heater disposed in the case and configured to generate heat; a support disposed in the case and including a cavity for accommodating an aerosol generating article; a rib formed on an inner surface of the support and extending along a circumferential direction of the cavity such that an outer circumferential surface of the aerosol generating article accommodated in the cavity is surrounded by the rib; and an air flow path formed between the case and the support such that air is introduced into the cavity.

10 Claims, 9 Drawing Sheets

(56) References Cited

U.S. PATENT DOCUMENTS

| | | | | |
|---|---|---|---|---|
| 11,478,018 | B2 | 10/2022 | Mironov et al. | |
| 2014/0338686 | A1* | 11/2014 | Plojoux | A24F 40/485 131/329 |
| 2015/0013696 | A1* | 1/2015 | Plojoux | A61M 15/06 131/328 |
| 2018/0049472 | A1 | 2/2018 | Mahler et al. | |
| 2020/0154765 | A1* | 5/2020 | Lee | A24F 40/40 |
| 2020/0236999 | A1 | 7/2020 | Mironov et al. | |
| 2020/0375249 | A1 | 12/2020 | Yanez | |
| 2021/0244097 | A1 | 8/2021 | Qiu et al. | |
| 2021/0298359 | A1 | 9/2021 | Li et al. | |
| 2022/0125105 | A1 | 4/2022 | Mahler et al. | |
| 2023/0108821 | A1 | 4/2023 | Yoon | |

FOREIGN PATENT DOCUMENTS

| | | | | |
|---|---|---|---|---|
| CN | 109123807 | A | 1/2019 | |
| CN | 208941055 | U | 6/2019 | |
| CN | 209527875 | U | 10/2019 | |
| CN | 211558818 | U | 9/2020 | |
| CN | 112218553 | A | 1/2021 | |
| JP | 2014-533513 | A | 12/2014 | |
| JP | 2020-513193 | A | 5/2020 | |
| KR | 10-0404704 | B1 | 10/2004 | |
| KR | 10-2017-0115492 | A | 10/2017 | |
| KR | 10-2020-0024312 | A | 3/2020 | |
| RU | 2 602 053 | C2 | 2/2016 | |
| WO | 94/06314 | A1 | 3/1994 | |
| WO | 2013/076098 | A2 | 5/2013 | |
| WO | 2013/098395 | A1 | 7/2013 | |
| WO | WO-2020089114 | A1 * | 5/2020 | A24D 1/20 |

OTHER PUBLICATIONS

Written Opinion for PCT/KR2022/000937 dated Apr. 28, 2022.
Korean Office Action dated Jan. 26, 2023 in Korean Application No. 10-2021-0013176.
Japanese Office Action issued Apr. 16, 2024 in Application No. 2022-559468.
Russian Office Action issued Jan. 30, 2024 in Application No. 2022121592/03.
Extended European Search Report issued Jun. 15, 2023 in Application No. 22746138.1.
Communication dated Oct. 17, 2023, issued in Japanese Application No. 2022-559468.
First Office Action issued in Chinese Application No. 202280002597.6 dated Jun. 29, 2024 (12 Pages).
Office Action dated Oct. 8, 2024, received in Japanese Patent Application No. 2022-559468.

* cited by examiner

[Fig. 2]
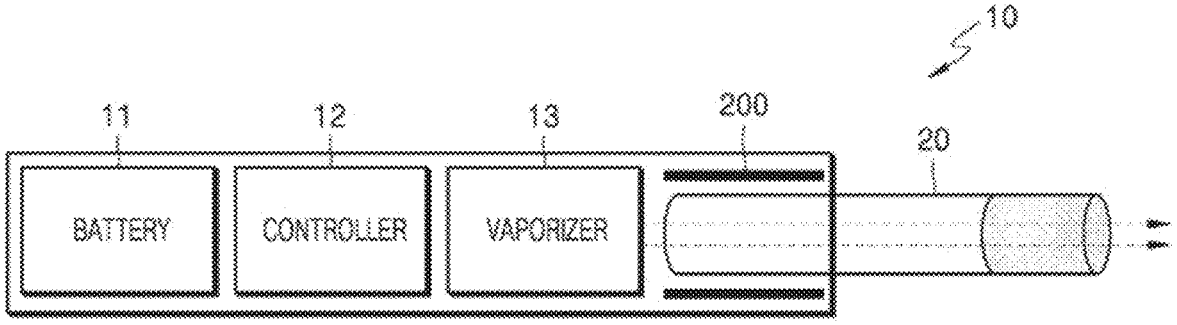

[Fig. 3]
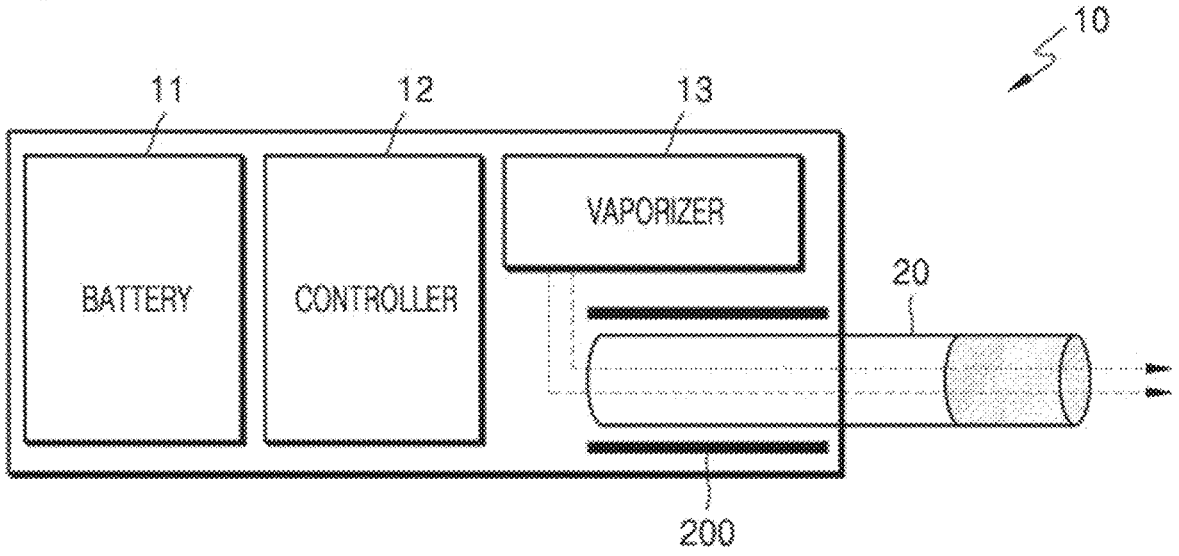

[Fig. 4]
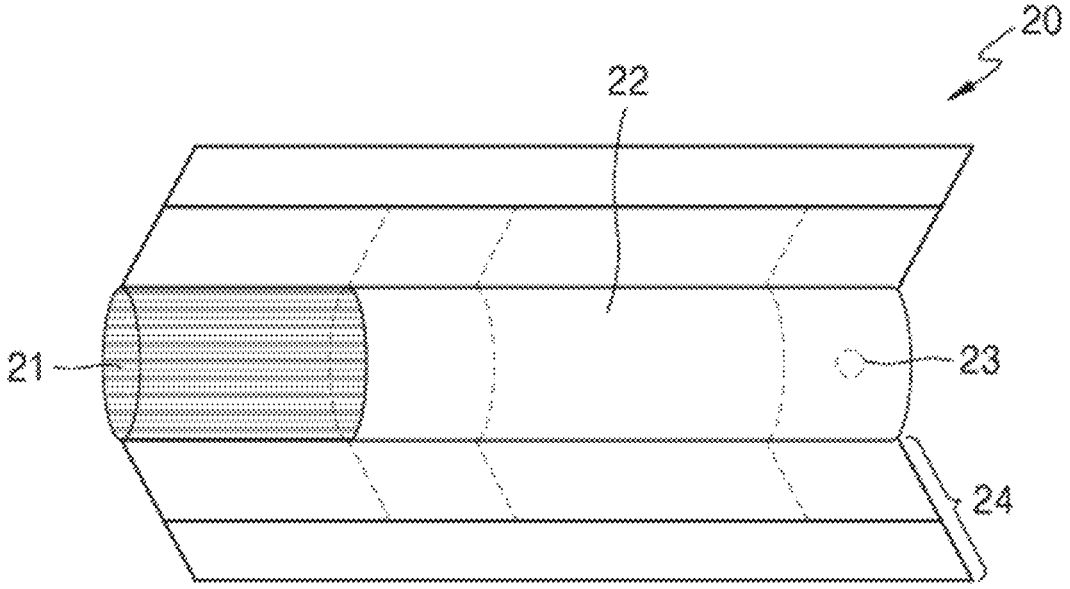

[Fig. 5]
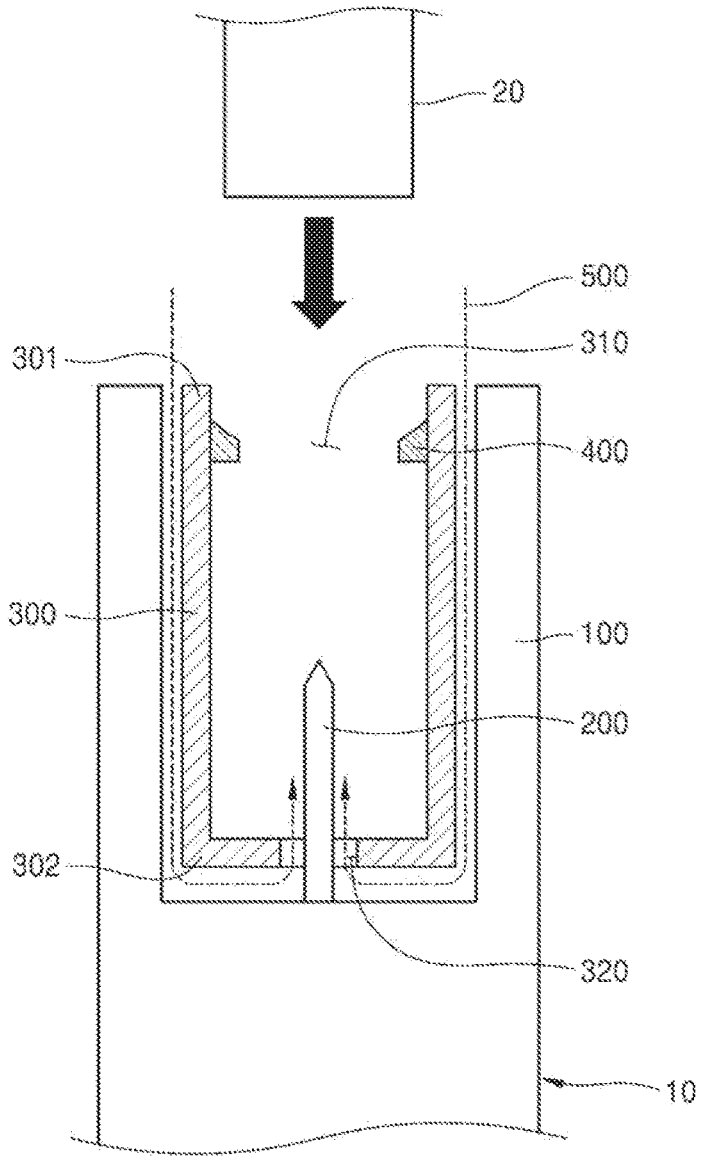
[Fig. 6]
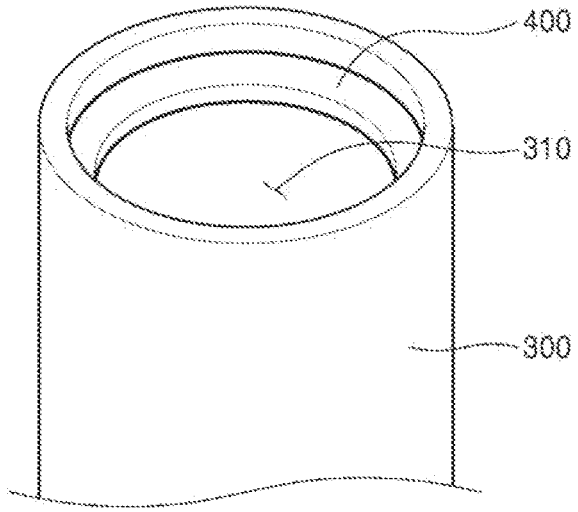

[Fig. 7]
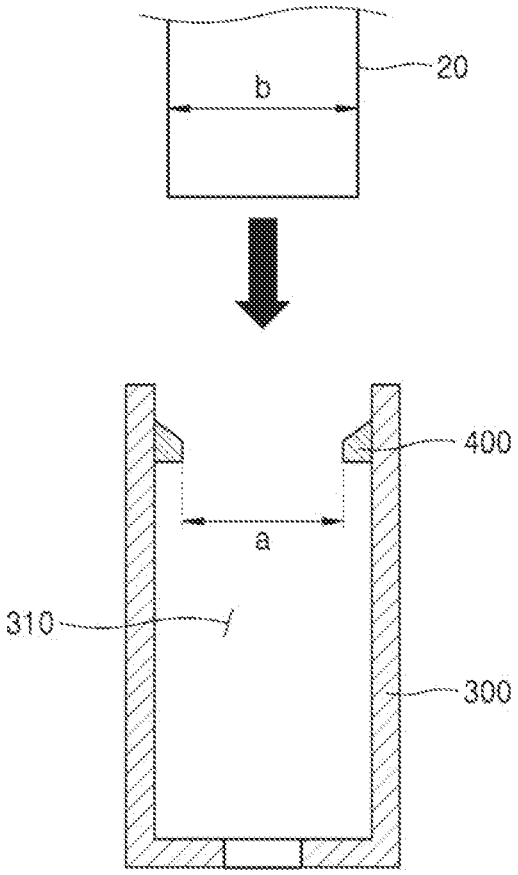
[Fig. 8A]
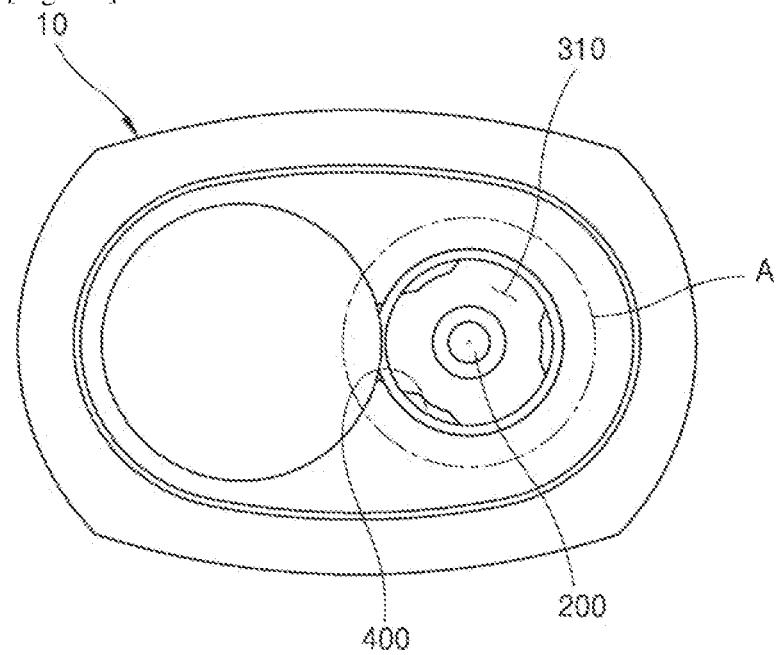

[Fig. 8B]
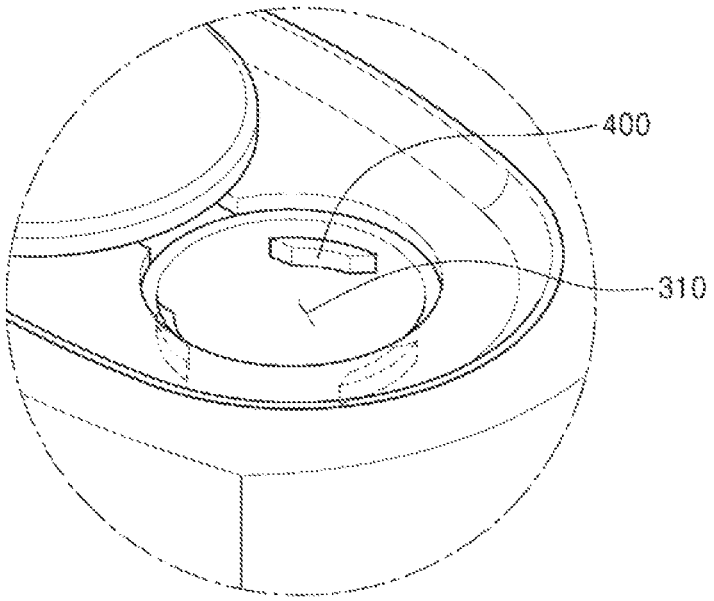
[Fig. 8C]
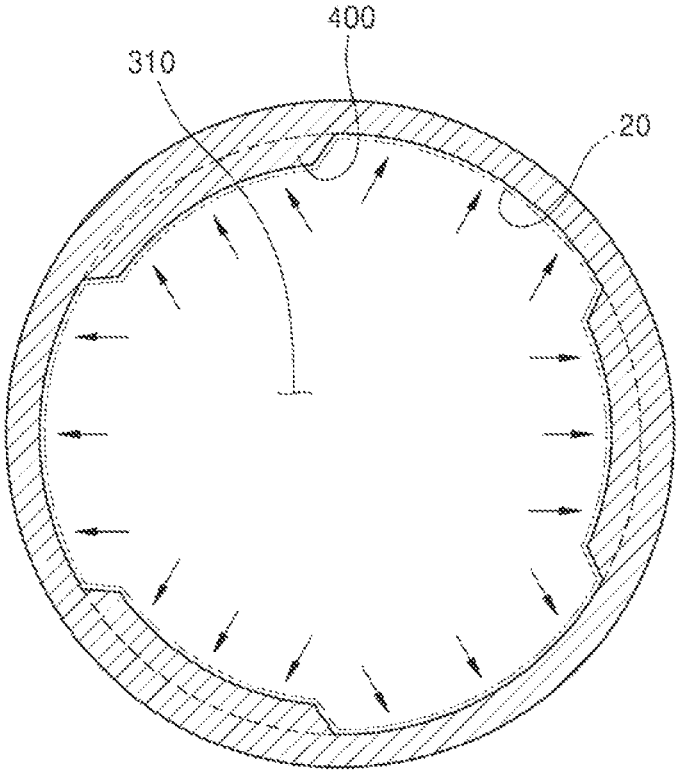

[Fig. 9A]
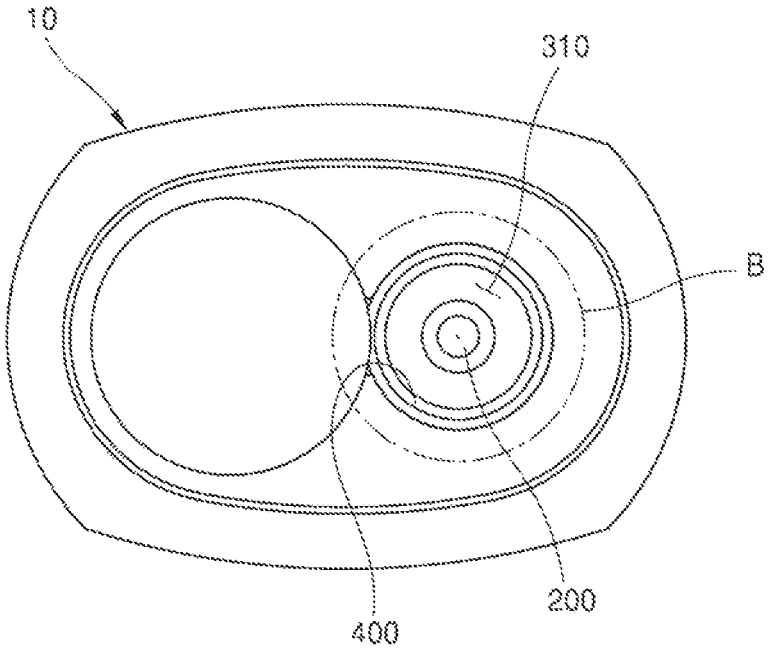
[Fig. 9B]
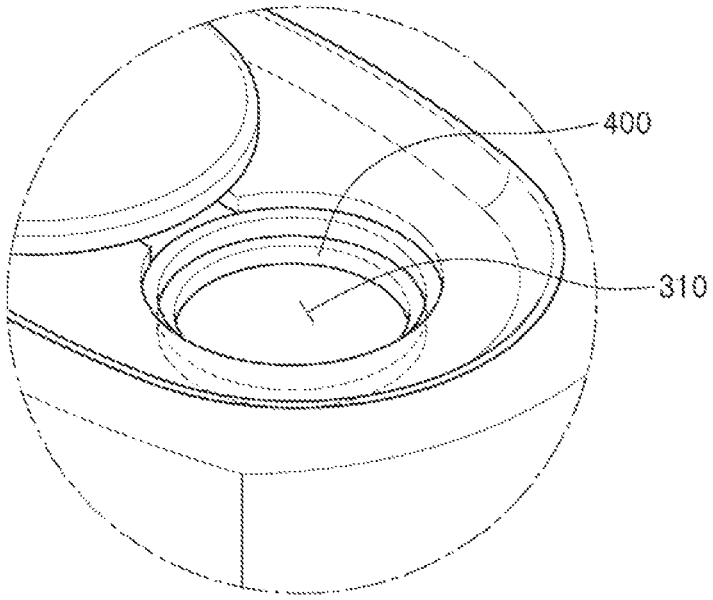

[Fig. 9C]
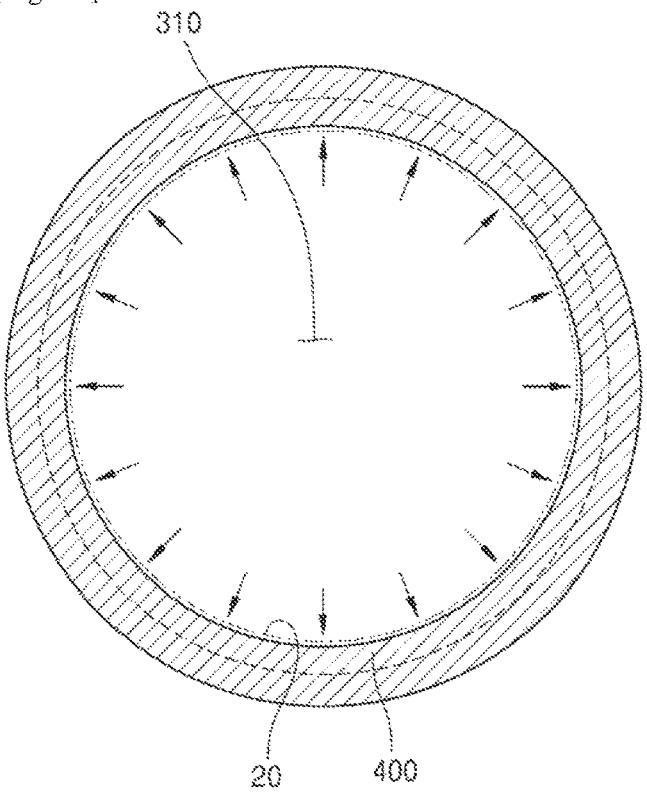
[Fig. 10]
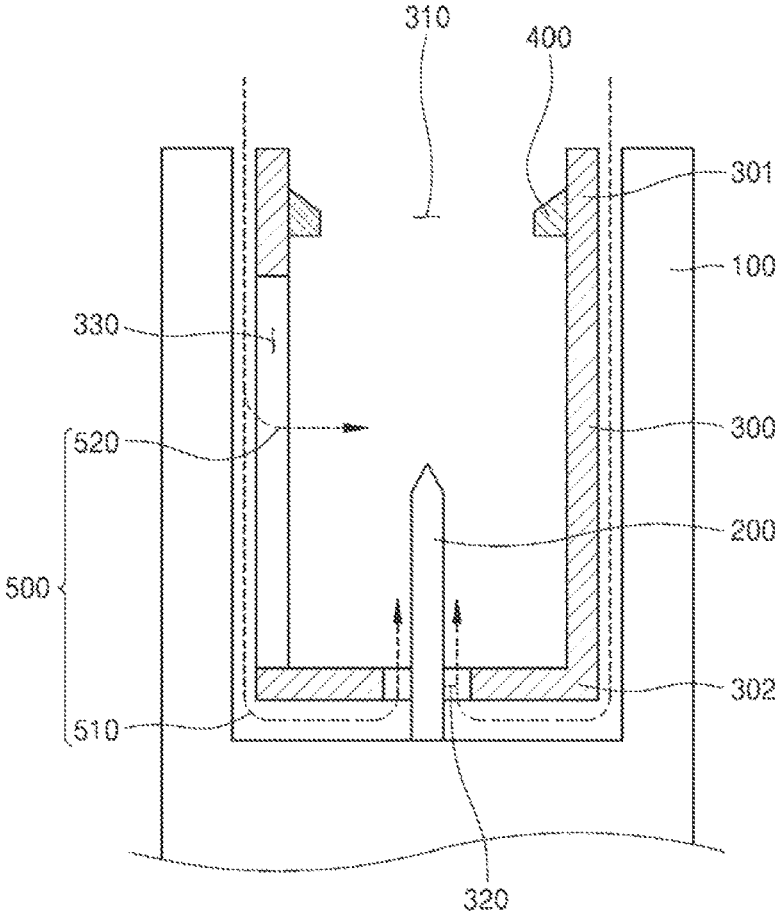

AEROSOL GENERATING DEVICE

CROSS REFERENCE TO RELATED APPLICATIONS

This application is a National Stage of International Application No. PCT/KR2022/000937 filed Jan. 18, 2022, claiming priority based on Korean Patent Application No. 10-2021-0013176 filed Jan. 29, 2021.

TECHNICAL FIELD

Embodiments relate to an aerosol generating device that generates an aerosol by heating an aerosol generating article.

BACKGROUND ART

Recently, the demand for alternatives to traditional cigarettes has increased. For example, there is growing demand for an aerosol generating device that generates aerosols by heating an aerosol generating material without combustion. Accordingly, researches on a heating-type aerosol generating device have been actively conducted.

DISCLOSURE OF INVENTION

Technical Problem

In use of an aerosol generating device, the shape of a cross-section of an aerosol generating article (e.g., cigarette) may be deformed over time by the application of heat to the aerosol generating article. As the shape of the cross-section of the aerosol generating article is irregularly deformed, the delivery amount of components of the aerosol may change irregularly with time. As a result, the smoking taste and the amount of atomization may not be consistent during use of the aerosol generating device.

In addition, a gap may formed between the aerosol generating article and the aerosol generating device, and thus an air flow path may be unexpectedly formed. In particular, as the cross-section of the shape of the aerosol generating article is irregularly deformed, the amount of air introduced into the gap may be irregular. In this case, the amount of the aerosol-generating material that is used to generate the aerosol during smoking may not be constant.

In addition, if the aerosol generating article is not inserted into the aerosol generating device along a correct direction, the delivery amount of components of the aerosol may be different each time. Also, if the aerosol generating article adheres to the lips, the aerosol generating article may be unintentionally pulled out of the aerosol-generating device.

The technical problems to be solved by the present embodiments are not limited to the technical problems as described above, and other technical problems may be inferred from the following embodiments.

Solution to Problem

Embodiments provide an aerosol generating device capable of aligning the insertion direction of the aerosol generating article with a predetermined alignment position of the aerosol generating device, and fixing the position of the aerosol generating article accommodated in the aerosol generating device.

Embodiments provide an aerosol generating device capable of maintaining a constant shape of a cross-section of an aerosol generating article and preventing generation of unexpected airflow path.

An aerosol generating device according to an embodiment in order to solve the above problems includes a case; a heater disposed in the case and configured to generate heat; a support disposed in the case and including a cavity for accommodating an aerosol generating article; a rib formed on an inner surface of the support and extending along a circumferential direction of the cavity such that an outer circumferential surface of the aerosol generating article accommodated in the cavity is surrounded by the rib; and an air flow path formed between the case and the support such that air is introduced into the cavity.

Advantageous Effects of Invention

The aerosol generating device according to the embodiments may provide a constant tobacco taste and atomization amount by guiding insertion of the aerosol generating article into the aerosol generating device and fixing the aerosol generating article inserted in the aerosol generating device.

In addition, the aerosol generating device according to the embodiments may generate an aerosol of consistent composition by maintaining a constant shape of the cross-section of the aerosol generating article and preventing generation of an unwanted airflow path.

BRIEF DESCRIPTION OF DRAWINGS

FIGS. 1 through 3 are diagrams showing examples in which a cigarette is inserted into an aerosol generating device.

FIG. 4 illustrates an example of a cigarette.

FIG. 5 is a cross-sectional view of an aerosol generating device according to an embodiment.

FIG. 6 is a perspective view of the support shown in FIG. 5.

FIG. 7 is a cross-sectional view of the support shown in FIG. 5.

FIG. 8A is a plan view of an aerosol generating device manufactured as a comparative example, FIG. 8B is an enlarged perspective view of part A of FIG. 8A, and FIG. 8C is a cross-sectional view of the support in a state in which an aerosol generating article is inserted into the aerosol generating device shown in FIG. 8A.

FIG. 9A is a plan view of an aerosol generating device according to an embodiment, FIG. 9B is an enlarged perspective view of part B of FIG. 9A, and FIG. 9C is a cross-sectional view of a support in a state in which an aerosol generating article is inserted into the aerosol generating device shown in FIG. 9A.

FIG. 10 is a cross-sectional view of an aerosol generating device according to another embodiment.

MODE FOR THE INVENTION

Figure 1:
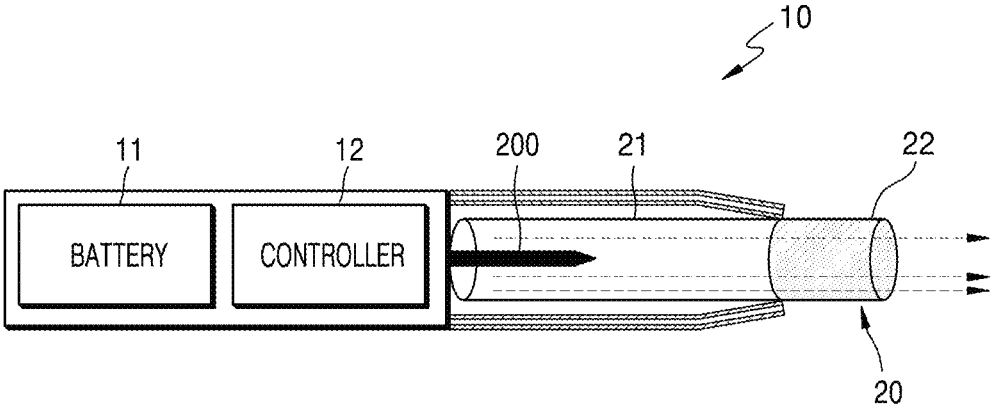

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression. "at least one of a, b, and c," should be understood as including only a, only b, only c, both a and b, both a and c, both b and c, or all of a, b, and c.

The term "aerosol generating article" may refer to a product designed for smoking by a person puffing on the aerosol generating article. The aerosol generating article may include an aerosol generating material that generates aerosols without combustion. For example, one or more aerosol generating articles may be loaded in an aerosol generating device and generate aerosols when heated by the aerosol generating device. The shape, size, material, and structure of the aerosol generating article may differ according to embodiments. Examples of the aerosol generating article may include, but are not limited to, a cigarette-shaped substrate and a cartridge. Hereinafter, the term "cigarette" (i.e., when used alone without a modifier such as "general," "traditional," or "combustive") may refer to an aerosol generating article which has a shape and a size similar to those of a traditional combustive cigarette.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 through 3 are diagrams showing examples in which a cigarette is inserted into an aerosol generating device.

Referring to FIG. 1, the aerosol generating device 10 may include a battery 11, a controller 12, and a heater 200. Referring to FIGS. 2 and 3, the aerosol generating device 10 may further include a vaporizer 13. Also, the aerosol generating article 20 may be inserted into an inner space of the aerosol generating device 10.

FIGS. 1 through 3 illustrate components of the aerosol generating device 10, which are related to the present embodiment. Therefore, it will be understood by one of ordinary skill in the art related to the present embodiment that other general-purpose components may be further included in the aerosol generating device 10, in addition to the components illustrated in FIGS. 1 through 3.

Also, FIGS. 2 and 3 illustrate that the aerosol generating device 10 includes the heater 200. However, as necessary, the heater 200 may be omitted.

FIG. 1 illustrates that the battery 11, the controller 12, and the heater 200 are arranged in series. Also, FIG. 2 illustrates that the battery 11, the controller 12, the vaporizer 13, and the heater 200 are arranged in series. Also, FIG. 3 illustrates that the vaporizer 13 and the heater 200 are arranged in parallel. However, the internal structure of the aerosol generating device 10 is not limited to the structures illustrated in FIGS. 1 through 3. In other words, according to the design of the aerosol generating device 10, the battery 11, the controller 12, the heater 200, and the vaporizer 13 may be differently arranged.

When the aerosol generating article 20 is inserted into the aerosol generating device 10, the aerosol generating device 10 may operate the heater 200 and/or the vaporizer 13 to generate aerosol from the aerosol generating article 20 and/or the vaporizer 13. The aerosol generated by the heater 200 and/or the vaporizer 13 is delivered to a user by passing through the aerosol generating article 20.

As necessary, even when the aerosol generating article 20 is not inserted into the aerosol generating device 10, the aerosol generating device 10 may heat the heater 200.

The battery 11 may supply power to be used for the aerosol generating device 10 to operate. For example, the battery 11 may supply power to heat the heater 200 or the vaporizer 13, and may supply power for operating the controller 12. Also, the battery 11 may supply power for operations of a display, a sensor, a motor, etc. mounted in the aerosol generating device 10.

The controller 12 may generally control operations of the aerosol generating device 10. In detail, the controller 12 may control not only operations of the battery 11, the heater 200, and the vaporizer 13, but also operations of other components included in the aerosol generating device 10. Also, the controller 12 may check a state of each of the components of the aerosol generating device 10 to determine whether or not the aerosol generating device 10 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 200 may be heated by the power supplied from the battery 11. For example, when the aerosol generating article 20 is inserted into the aerosol generating device 10, the heater 200 may be located outside the aerosol generating article 20. Thus, the heated heater 200 may increase a temperature of an aerosol generating material in the aerosol generating article 20.

The heater 200 may include an electro-resistive heater. For example, the heater 200 may include an electrically conductive track, and the heater 200 may be heated when currents flow through the electrically conductive track. However, the heater 200 is not limited to the example described above and may include all heaters which may be heated to a desired temperature. Here, the desired temperature may be pre-set in the aerosol generating device 10 or may be set by a user.

As another example, the heater 200 may include an induction heater. In detail, the heater 200 may include an electrically conductive coil for heating an aerosol generating article in an induction heating method, and the aerosol generating article may include a susceptor which may be heated by the induction heater.

For example, the heater 200 may include a tube-type heating element, a plate-type heating element, a needle-type heating element, or a rod-type heating element, and may heat the inside or the outside of the aerosol generating article 20, according to the shape of the heating element.

Also, the aerosol generating device 10 may include a plurality of heaters 20. Here, the plurality of heaters 20 may be inserted into the aerosol generating article 20 or may be arranged outside the aerosol generating article 20. Also, some of the plurality of heaters 20 may be inserted into the aerosol generating article 20 and the others may be arranged outside the aerosol generating article 20. In addition, the shape of the heater 200 is not limited to the shapes illustrated in FIGS. 1 through 3 and may include various shapes.

The vaporizer 13 may generate aerosol by heating a liquid composition and the generated aerosol may pass through the aerosol generating article 20 to be delivered to a user. In other words, the aerosol generated via the vaporizer 13 may move along an air flow passage of the aerosol generating device 10 and the air flow passage may be configured such that the aerosol generated via the vaporizer 13 passes through the aerosol generating article 20 to be delivered to the user.

For example, the vaporizer 13 may include a liquid storage, a liquid delivery element, and a heating element, but it is not limited thereto. For example, the liquid storage, the liquid delivery element, and the heating element may be included in the aerosol generating device 10 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 13 or may be formed integrally with the vaporizer 13.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 13 may be referred to as a cartomizer or an atomizer, but it is not limited thereto.

The aerosol generating device 10 may further include general-purpose components in addition to the battery 11, the controller 12, the heater 200, and the vaporizer 13. For example, the aerosol generating device 10 may include a display capable of outputting visual information and/or a motor for outputting haptic information. Also, the aerosol generating device 10 may include at least one sensor (e.g., a puff sensor, a temperature sensor, an aerosol generating article insertion detecting sensor, etc.). Also, the aerosol generating device 10 may be formed as a structure that, even when the aerosol generating article 20 is inserted into the aerosol generating device 10, may introduce external air or discharge internal air.

Although not illustrated in FIGS. 1 through 3, the aerosol generating device 10 and an additional cradle may form together a system. For example, the cradle may be used to charge the battery 11 of the aerosol generating device 10. Alternatively, the heater 200 may be heated when the cradle and the aerosol generating device 10 are coupled to each other.

The aerosol generating article 20 may be similar to a general combustive cigarette. For example, the aerosol generating article 20 may be divided into a first portion including an aerosol generating material and a second portion including a filter, etc. Alternatively, the second portion of the aerosol generating article 20 may also include an aerosol generating material. For example, an aerosol generating material made in the form of granules or capsules may be inserted into the second portion.

The entire first portion may be inserted into the aerosol generating device 10, and the second portion may be exposed to the outside. Alternatively, only a portion of the first portion may be inserted into the aerosol generating device 10, or the entire first portion and a portion of the second portion may be inserted into the aerosol generating device 10. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 10. For example, opening and closing of the air passage and/or a size of the air passage formed in the aerosol generating device 10 may be adjusted by the user. Accordingly, the amount of smoke and a smoking impression may be adjusted by the user. As another example, the external air may flow into the aerosol generating article 20 through at least one hole formed in a surface of the aerosol generating article 20.

Hereinafter, the examples of the aerosol generating article 20 will be described with reference to FIG. 4.

FIG. 4 illustrates an example of a cigarette.

Referring to FIG. 4, the aerosol generating article 20 may include a tobacco rod 21 and a filter rod 22. The first portion described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

The aerosol generating article 20 may be packaged using at least one wrapper 24. The wrapper 24 may have at least one hole through which external air may be introduced or internal air may be discharged. For example, the aerosol generating article 20 may be packaged by one wrapper 24. As another example, the aerosol generating article 20 may be doubly packaged by two or more wrappers 24. For example, the tobacco rod 21 may be packaged by a first wrapper, and the filter rod 22 may be packaged by a second wrapper. And, the tobacco rod 21 and the filter rod 22 wrapped by individual wrappers are coupled to each other, and the entire cigarette 20 may be rewrapped by a third wrapper. When the tobacco rod 21 or the filter rod 22 includes a plurality of segments, each segment may be packaged by individual wrappers. In addition, the entire cigarette 20 in which segments wrapped by individual wrappers are combined may be rewrapped by another wrapper.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The filter rod 22 may be formed to generate flavors. For example, a flavoring liquid may be injected onto the filter rod 22, or an additional fiber coated with a flavoring liquid may be inserted into the filter rod 22.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

When the filter rod 22 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Meanwhile, although not shown in FIG. 4, the cigarette 20 according to an embodiment may further include a front-end filter. The front-filter may be located on one side of the tobacco rod 21 which is opposite to the other side facing the filter rod 22. The front-filter may prevent the tobacco rod 21 from being detached outwards and prevent the liquefied aerosol from flowing from the tobacco rod 21 into the aerosol generating device (10 of FIGS. 1 through 3), during smoking.

FIG. 5 is a cross-sectional view of an aerosol generating device according to an embodiment, and FIG. 6 is a perspective view of the support shown in FIG. 5.

Referring to FIG. 5, the aerosol generating device 10 according to an embodiment includes a case 100, a heater 200 disposed in the case 100 to generate heat, and a cavity 310 for accommodating the aerosol generating article 20, a support 300 disposed on the case 100, a rib 400 disposed on an inner circumferential surface of the cavity 310, and an airflow path 500 through which air flows. Components of the aerosol generating device 10 according to an embodiment are not limited to the components shown in the drawings, and may further include components of the general aerosol generating device 10.

The heater 200 and the support 300 may be disposed inside the case 100. The support 300 may be detachably accommodated in the case 100. When the support 300 is accommodated in the case 100, the inner wall of the case 100 and the outer wall of the support 300 may face each other.

The support 300 may include a cavity 310 for accommodating the aerosol generating article 20. The cavity 310 may be an empty space inside the support 300. The cavity 310 may extend from one end 301 of the support 300 into which the aerosol generating article 20 is inserted toward the other end 302 opposite the one end 301. The one end 301 may be open to allow an aerosol generating article 20 to be inserted. The aerosol generating article 20 may be inserted into the cavity 310 through one end 301 of the support 300. When the aerosol generating article 20 is fully inserted into the cavity 310, the aerosol generating article 20 may be accommodated in the cavity 310, coming in contact with the other end 302 of the support 300.

The heater 200 may generate heat for heating the aerosol generating article 20, thereby generating an aerosol. As shown in FIG. 5, the support 300 may include a through hole 320 at the other end 302, and the heater 200 may penetrate the other end 302 through the through hole 320 to be present in the cavity 310. When the aerosol generating article 20 is fully inserted into the cavity 310, the heater 200 may be disposed adjacent the aerosol generating article 20. In FIG. 5, the heater 200 is shown in a form to be inserted into the interior of the aerosol generating article 20, but is not limited thereto. The heater 200 may have any shape as long as the heater 200 is capable of transferring heat to the aerosol generating article 20 accommodated in the cavity 310.

Referring to FIG. 6, the rib 400 is disposed along the circumferential direction of the cavity 310, and may protrude toward the cavity 310. Referring to FIG. 5, the aerosol generating article 20 is inserted along the direction in which the cavity 310 extends. When the user inserts the aerosol generating article 20 such as a cigarette into the cavity 310, if the aerosol generating article 20 is inserted into the cavity 310 while not aligned with the extension direction of the cavity 310, the aerosol generating article 20 accommodated in the cavity 310 may not be aligned with the position of the heater 200. In this case, the heater 200 may be not inserted in the middle portion of the end of the aerosol generating article 20, but may be inserted into other portion of the end of the aerosol generating article 20.

Being disposed along the circumferential direction of the cavity 310, the rib 400 may guide the movement of the aerosol generating article 20 such that the aerosol generating article 20 is inserted into the cavity 310 along the extension direction of the cavity 310. In other words, the rib 400 may align the position of the aerosol generating article 20 with the position of the heater 200 inside the support 300 by guiding the insertion direction of the aerosol generating article 20. To this end, the rib 400 may be disposed adjacent one end 301 of the support 300. The rib 400 may be a flexible material to guide the movement of the aerosol generating article 20 without damaging the aerosol generating article 20.

The surface of the rib 400 may be inclined relative to the extension direction of the cavity 310 (i.e., longitudinal direction) and the horizontal direction perpendicular to the extension direction of the cavity 310, so as not to protrude into the cavity 310 in a way that impedes the insertion of the aerosol generating article 20. Accordingly, the aerosol generating article 20 may be inserted naturally and smoothly even though the rib 400 protrudes into the cavity 310. Also, the rib 400 may be convexly curved toward the cavity 310 for smooth guidance of the aerosol generating article 20. The curved shape may be a semicircle shape or a quadrant shape in cross section. However, the shape of the rib 400 may vary, and is not limited to the above-described shapes.

Also, a plurality of ribs 400 may be disposed along the direction in which the cavity 310 extends. The plurality of ribs 400 may have different degrees of protrusion toward the cavity 310.

When the aerosol-generating device 10 is accommodated in the cavity 310, the ribs 400 may be arranged to surround the outer circumferential surface of the aerosol generating article 20. The rib 400 may contact the aerosol generating article 20 along a circumferential direction of the outer circumferential surface of the aerosol generating article 20. As such, the ribs 400 may maintain the shape of a cross-section of the aerosol generating article 20 when using the aerosol-generating device 10, and may serve to fix the position of the aerosol generating article 20 in the cavity 310.

The size and shape of the support 300 may correspond to the size and shape of the aerosol generating article 20. For example, when the aerosol generating article 20 has a cylindrical shape, the support 300 may have a hollow cylindrical shape to accommodate the cylindrical aerosol generating article 20. When the support 300 has a hollow cylindrical shape, the ribs 400 protruding from the inner circumferential surface of the support 300 toward the cavity 310 may have a ring shape extending along the circumferential direction of the cavity 310.

The support 300 and the rib 400 may be integrally injection-molded to be integrally formed, which facilitates easy manufacture of the support 300. Alternatively, the support 300 and the rib 400 may be independently manufactured and then assembled. After the support 300 and the rib 400 are separately manufactured, the coupling portion may be assembled by screw coupling or interference fitting. In other words, the rib 400 may be separately manufactured and then assembled onto the inner circumferential surface of the support 300. In this case, the rib 400 may be coupled to the support 300 such that the inner end protrudes toward the cavity 310. The airflow path 500 is a movement path of the air flowing through the inflow of external air into the aerosol generating device 10. The air flows along the airflow path 500 and mixes with the aerosol before being provided to the user.

The airflow path 500 of the aerosol generating device 10 according to the embodiment may be provided so that air flows into the cavity 310 through a gap between the case 100 and the support 300. In other words, the airflow path 500 is formed such that air flows between the inner wall of the case 100 and the outer wall of the support 300, in a direction from one end 301 of the support body toward the other end 302, and passes through the other end 302 of the support 300 into the cavity 310. The airflow path 500 may be provided so that air flows into the cavity 310 through the above-described through hole 320.

Because the rib 400 surrounds and contacts the outer circumferential surface of the aerosol generating article 20 when the aerosol generating article 20 is inserted into the cavity 310, air introduced between the cavity 310 and the aerosol generating article 20 may be blocked. Accordingly, the airflow path 500 of the aerosol generating device 10 according to the embodiments is provided so that air flows into the cavity 310 through the space between the case 100 and the support 300, and air may be prevented from directly flowing into the cavity 310 through the one end 301 of the support 300.

FIG. 7 is a cross-sectional view of the support shown in FIG. 5.

Referring to FIG. 7, the diameter a of the cavity 310 at the location of the rib 400 may be less than the diameter b of the aerosol generating article 20. The diameter a of the cavity 310 at the position of the rib 400 corresponds to the distance from one point on the rib 400 to another point on the rib 400 opposite the point, and is less than the diameter of the cross-section of the cavity 310 where the rib 400 is not located.

When the user inserts the aerosol generating article 20, the user may press the aerosol generating article 20 in the direction in which the cavity 310 extends at the position of the rib 400 such that the aerosol generating article 20 is fully accommodated in the cavity 310. When the aerosol generating article 20 is accommodated in the cavity 310, the rib 400 may fully contact the outer circumferential surface of the aerosol generating article 20. As such, the rib 400 may thus fix the position of the aerosol generating article 20 in the cavity 310, and may block air directly flowing in between the aerosol generating article 20 and the cavity 310.

Hereinafter, effects of the aerosol generating device 10 according to the embodiment will be described with reference to the drawings.

FIG. 8A is a plan view of an aerosol generating device according to a comparative example, FIG. 8B is an enlarged perspective view of part A of FIG. 8A, and FIG. 8C is a cross-sectional view of the support in a state in which an aerosol generating article is inserted into the aerosol generating device shown in FIG. 8A.

FIGS. 8A to 8C are views illustrating the aerosol generating device 10 in which a plurality of ribs 400 are disposed to be spaced apart from each other in the circumferential direction of the cavity 310.

Because the user repeatedly bites the end of the aerosol generating article 20 in his mouth when using the aerosol-generating device 10, a situation may arise where the aerosol generating article 20 adheres to the lips and thereby the aerosol generating article 20 is pulled out of the cavity 310. In the case of the aerosol generating device 10 shown in FIG. 8A, if the fixing force of the aerosol generating article 20 by the rib 400 is insufficient, a situation may occur in which the aerosol generating article 20 attaches to the user's lips and gets removed from the cavity 310 during use.

When the aerosol generating device 10 is activated, since the heater 200 heats the aerosol generating article 20 to generate an aerosol, and the generated aerosol is provided to a user through the aerosol generating article 20, the shape of the aerosol generating article 20 may be deformed, thereby expanding the cross-section thereof.

Referring to FIG. 8C, the cross-section of the aerosol generating article 20 may be irregularly expanded between the disposed plurality of ribs 400. Accordingly, when the aerosol-generating device 10 is used, the shape of the aerosol generating article 20 may change over time, which may cause inconsistency in the composition of the generated aerosol.

In addition, in the case of the aerosol generating device 10 shown in FIG. 8A to 8C, each time the aerosol generating article 20 is inserted into the cavity 310, a deviation may occur in the position of the aerosol generating article 20 with respect to the cavity 310, which means that the position of the aerosol generating article 20 relative to the heater 200 may not be constant every time the aerosol-generating device 10 is used. Thus, the heat transferred to the aerosol generating article 20 may not be constant, and a difference may occur in the degree to which the shape of the cross-section of the aerosol generating article 20 is deformed. As a result, the composition of the generated aerosol may not be constant.

In addition, a gap may be generated between the plurality of ribs 400 spaced apart from each other, and external air may be directly introduced into the cavity 310 through the gap, thereby generating an unintentional air flow path. Because the deformable cross-sectional shape of the aerosol generating article 20 is irregular, the aforementioned gap may occur irregularly during use. Therefore, because the amount of air flowing directly into the cavity 310 is not constant, the use amount of the aerosol-generating material included in the aerosol generating article 20 may not be constant. Therefore, the composition of the aerosol generated in the aerosol generating device 10 may not be constant.

To sum up, since the shape of the aerosol-generating material may be irregularly deformed by the plurality of ribs 400 disposed spaced apart, the insertion position of the aerosol generating article 20 may not be aligned, and the airflow path 500 for directly introducing air into the cavity 310 is generated, the smoking taste may not be consistent whenever the aerosol generating device 10 is used, and a deviation may occur in the atomization amount.

FIG. 9A is a plan view of the aerosol generating device according to an embodiment, FIG. 9B is an enlarged perspective view of part B of FIG. 9A, and FIG. 9C is a cross-sectional view of the support in a state in which an aerosol generating article is inserted into the aerosol generating device shown in FIG. 9A.

Referring to FIGS. 9A and 9B, the aerosol generating article 20 may be disposed along the circumferential direction of the cavity 310 in which the aerosol generating article 20 is accommodated. Thus, the rib 400 may contact with the outer circumferential surface of the aerosol generating article 20 accommodated in the cavity 310.

Referring to FIG. 9C, because the rib 400 contacts the outer circumferential surface of the aerosol generating article 20 along the circumferential direction, even if the shape of the aerosol generating article 20 is deformed when the aerosol-generating device 10 is used, the shape of the cross-section may be maintained. Accordingly, the composition of the aerosol generated may be constant.

In addition, in the aerosol generating device 10 according to an embodiment, even if the aerosol generating article 20 is inserted into the cavity 310 in different directions, the rib 400 may guide the aerosol generating article 20 such that the insertion direction of the aerosol generating article 20 is aligned with the extension direction of the cavity 310. Since the rib 400 allows the position of the aerosol generating article 20 with respect to the cavity 310 to be constant whenever the aerosol generating article 20 is inserted into the cavity 310, the heat transferred to the aerosol generating article 20 may be constant. As a result, the composition of the generated aerosol may be constant.

In addition, in the aerosol generating device 10 according to an embodiment, a gap between the aerosol generating article 20 and the cavity 310 may be sealed to prevent air from directly flowing into the cavity 310. Because a constant amount of air can flow in through the airflow path 500 between the case 100 and the support 300, the amount of the aerosol-generating material used to generate an aerosol in the aerosol generating article 20 may be constant. Therefore, whenever the aerosol generating device 10 is used, the composition of the aerosol generated may be constant.

According to the experiment, in the aerosol generating device 10 according to the embodiment, the delivery amount of the aerosol generating material such as nicotine and glycerin is increased by about 3% or more compared to the aerosol generating device 10 including a plurality of ribs 400 spaced apart from each other, and the same composition of the aerosol is maintained. Therefore, the aerosol generating device 10 according to an embodiment may maintain a constant smoking taste and atomization amount each time the aerosol generating device 10 is used.

FIG. 10 is a cross-sectional view of an aerosol generating device according to another embodiment. Except for the description below, the configuration is the same as the aerosol generating device 10 according to the above-described embodiments, and the same reference numeral is used for the same component. In this regard, the repetitive description will be omitted.

Referring to FIG. 10, the aerosol generating device 10 according to an embodiment may include an opening 330 on the side surface of the support 300. The support 300 may include at least one opening 330. The opening 330 may be on the other end 302 side of the support 300 rather than the side surface where the rib 400 is provided.

The opening 330 may allow the user who has finished using the aerosol generating device 10 to easily remove the residue remaining in the cavity 310 after extracting the aerosol generating article 20. For example, after extracting the aerosol generating article 20 from the cavity 310, the user may remove the support 300 from the case 100 and remove residual debris through the opening 330.

If the user inserts the aerosol generating article 20 into the cavity 310 in a direction which is not aligned with the extension direction of the cavity 310, the aerosol generating article 20 may be exposed through the opening 330. In this case, the heater 200 may fail to evenly heat the aerosol generating article 20, and thereby the flavor may be weakened and atomization amount of the aerosol may be reduced. According to an embodiment, when the aerosol generating article 20 is inserted into the cavity 310, the rib 400 may prevent the aerosol generating article 20 from tilting towards the opening 330.

The rib 400 may be positioned closer to the one end 301 of the support 300 than the opening 330 to guide the aerosol generating article 20 such that the aerosol generating article 20 is inserted in the direction in which the cavity 310 extends.

Referring to FIG. 10, the airflow path 500 may include a main airflow path 510 and a sub airflow path 520. The main airflow path 510 may be provided such that air flows from one end 301 to the other end 302 on the outside of the support 300, passes through the other end 302, and flows into the cavity 310.

The sub airflow path 520 may be provided so that air flows from one end 301 to the other end 302 on the outside of the support 300, passes through the opening 330, and flows into the cavity 310. The amount of air flowing along the sub airflow path 520 may be adjusted depending on the size of the opening 330. In the aerosol generating device 10 according to another embodiment, because the sub airflow path 520 may be added to increase the amount of air introduced into the cavity 310, the amount of aerosol generated may increase and inhalation may be facilitated.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

a case;

a heater disposed in the case and configured to generate heat;

a support disposed in the case and including a cavity for accommodating an aerosol generating article;

at least one rib formed on an inner surface of the support and extending along a circumferential direction of the cavity such that the at least one rib surrounds and contacts the entirety of an outer circumferential surface of the aerosol generating article accommodated in the cavity and prevents any air from flowing in between the cavity and the aerosol generating article accommodated in the cavity; and an air flow path formed between the case and the support such that air is introduced into the cavity, wherein the at least one rib comprises:

a first rib protruding from the inner surface of the support by a first length; and a second rib protruding from the inner surface of the support by a second length different from the first length, wherein at least one of the first rib and the second rib is configured to fix a position of the aerosol generating article accommodated in the cavity.

2. The aerosol generating device of claim 1, wherein the air flow path allows air to flow from an one end of the support to another end of the support on an outside of the support, and pass through the other end of the support into the cavity.

3. The aerosol generating device of claim 1, wherein a diameter of the cavity at a location of the at least one rib is less than a diameter of the aerosol generating article.

4. The aerosol generating device of claim 1, wherein the support includes, at a side thereof, an opening that opens at least a portion of the cavity.

5. The aerosol generating device of claim 4, wherein the air flow path includes:

a first air flow path that allows air to flow from an one end of the support toward another end of the support on an outside of the support, and pass through the other end into the cavity; and a second air flow path that allows air to flow from the one end of the support toward the other end of the support on the outside of the support, and pass through the opening into the cavity.

6. The aerosol generating device of claim 1, wherein a surface of the at least one rib is inclined with respect to a direction in which the cavity extends.

7. The aerosol generating device of claim 1, wherein the support includes a through hole through which the heater penetrates the support to be present in the cavity.

8. The aerosol generating device of claim 7, wherein the air flow path allows air to enter the cavity through the through hole.

9. The aerosol generating device of claim 1, wherein the at least one rib is detachable from the support.

10. The aerosol generating device of claim 1, wherein the at least one rib protrudes toward the cavity.

* * * * *